US005499943A

United States Patent [19]

Terris

[11] Patent Number: 5,499,943

[45] Date of Patent: Mar. 19, 1996

[54] ROTARY CUTTER BLADE SHARPENER

[76] Inventor: Alta F. Terris, 4305 Northpointe Way, Pensacola, Fla. 32514-6630

[21] Appl. No.: 344,877

[22] Filed: Nov. 25, 1994

[51] Int. Cl.[6] ..... B24B 23/08

[52] U.S. Cl. ..... 451/549; 451/557; 451/558; 451/349; 451/359

[58] Field of Search ..... 451/545, 549, 451/557, 558, 44, 349, 358, 359, 541, 282, 241, 254, 258, 422, 423, 344, 540

[56] References Cited

U.S. PATENT DOCUMENTS

| | | | |
|---|---|---|---|
| 889,830 | 6/1908 | Van Berkel | 451/422 |
| 1,165,342 | 12/1915 | Peterson | 451/422 |
| 1,957,776 | 5/1934 | Gury | 451/422 |
| 2,721,430 | 10/1955 | Green | 451/422 |
| 3,315,452 | 4/1967 | Rossi | 451/423 |
| 3,349,485 | 10/1967 | Bettcher | 451/422 |
| 4,373,302 | 2/1983 | Darby | 451/374 |
| 5,031,363 | 7/1991 | Thiem | 451/344 |

*Primary Examiner*—Jack W. Lavinder
*Attorney, Agent, or Firm*—George A. Bode

[57] ABSTRACT

This invention is a tool designed to sharpen rotary cutter blades used for cutting fabrics. In the preferred embodiment, when a dulled blade is placed over a threaded shank, an inside-threaded clamp is screwed down upon the blade, pressing it tightly against a platform from which the shank rises, and holding the blade from turning. When an upper casing containing an inside angled abrasive strip is lowered over the clamp until contact is made against the blade surface, the abrasive strip is brought into contact with the blade edge. When the upper casing is rotated around the tightened clamp, the abrasive acts upon the blade edge and thereby sharpens the edge. Removing the upper casing and clamp, the blade is then turned over, replaced on the platform and the process repeated, thereby sharpening both sides of the blade edge.

2 Claims, 3 Drawing Sheets

FIG. 2
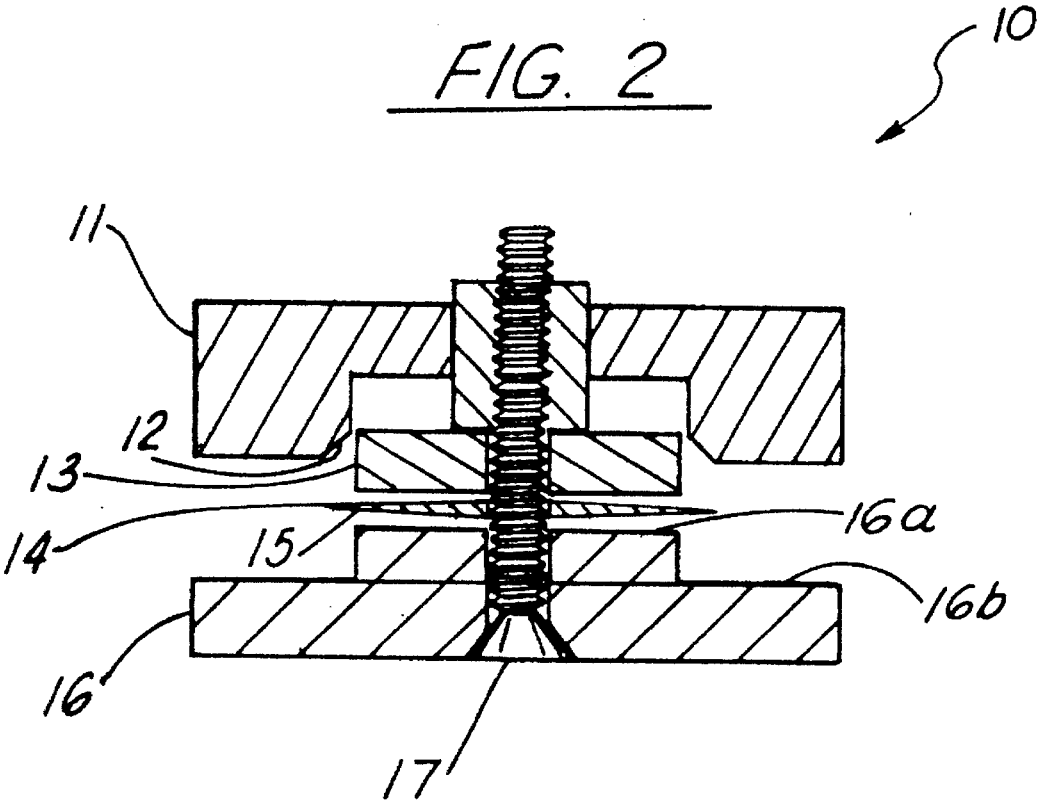
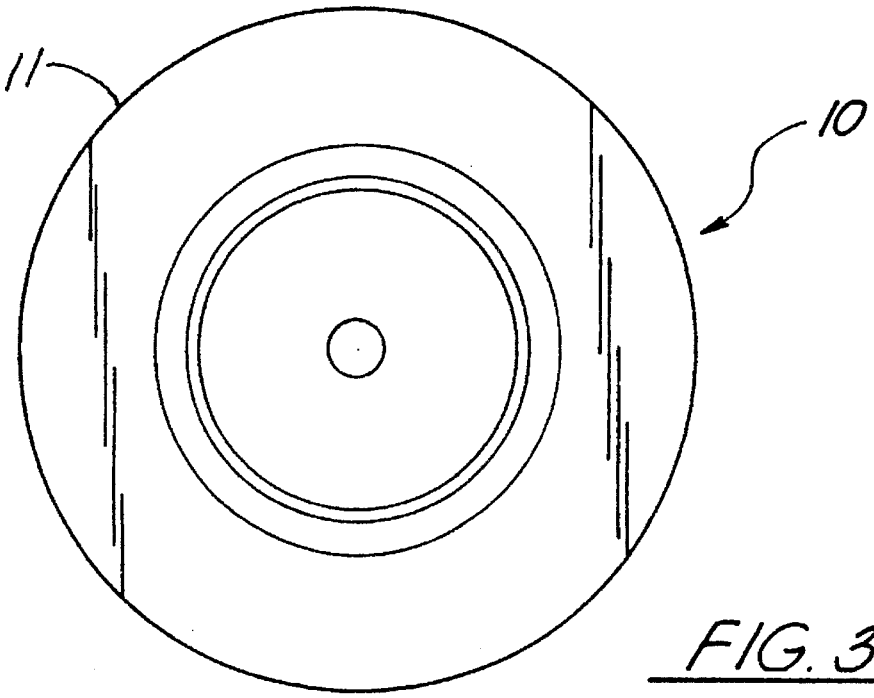
FIG. 3

ROTARY CUTTER BLADE SHARPENER

BACKGROUND OF THE INVENTION

Always on the lookout to save money, I searched the market in vain for a method to restore the dulled cutting edge of the blade in the popular rotary cutter most everybody uses for cutting fabric for home sewing. Finding none, I have invented a simple tool to do that very thing. The blades cost in the neighborhood of six ($6.00) dollars, and this invention will enable the user to extend the life of the blade many times over.

SUMMARY OF THE PRESENT INVENTION

The invention is a tool comprised of an upper component carrying an abrasive strip at a certain angle inside, a clamp for the purpose of holding the blade stationary against a lower platform which has a shank running up through it for positioning the several components.

When the components are assembled, the upper component brings the abrasive strip down against the blade edge being held by the clamp against the lower component or platform. A simple twisting or rotating of the upper component against the lower assembly causes the abrasive strip to act on the blade edge, sharpening it.

A compact tool especially designed to sharpen the cutting edge of a rotary cutter blade, consisting of a shanked platform onto which to place a cutter blade, a threaded clamp thereupon screwed down the shank to restrain the blade from rotating when an upper casing, containing an abrasive strip placed at a certain angle inside the upper casing, is placed over the shank and lowered into contact with the clamp and rotated in a clockwise and counterclockwise motion, said motion causing the abrasive strip to act upon the cutting edge of the blade and sharpening it.

The alternate embodiment comprises a rotary cutter blade sharpener tool comprised of an inner and an outer casing which form a two-part circular box, the inner casing of which contains a keyed hub on a platform upon which a rotary cutter blade is placed, the hub key restraining the blade from rotating; when the outer casing is fitted over and around the inner casing, thus bringing an abrasive strip affixed at a certain angle on a platform inside the outer casing into juxtaposition with the blade, the abrasive strip acts on the cutting edge of the rotary blade when the outer casing is rotated in clockwise and counterclockwise fashion around the inner casing, with the process being repeated when the box is disassembled and the blade turned over to sharpen the opposite of the blade edge.

BRIEF DESCRIPTION OF THE DRAWING

FIG. 2 is a cross-sectional view of the embodiment of FIG. 1 in a slightly opened position;

FIG. 3 is a top plan view of the embodiment of FIG. 1;

DETAILED DESCRIPTION OF THE PREFERRED EMBODIMENT

Figure 1:
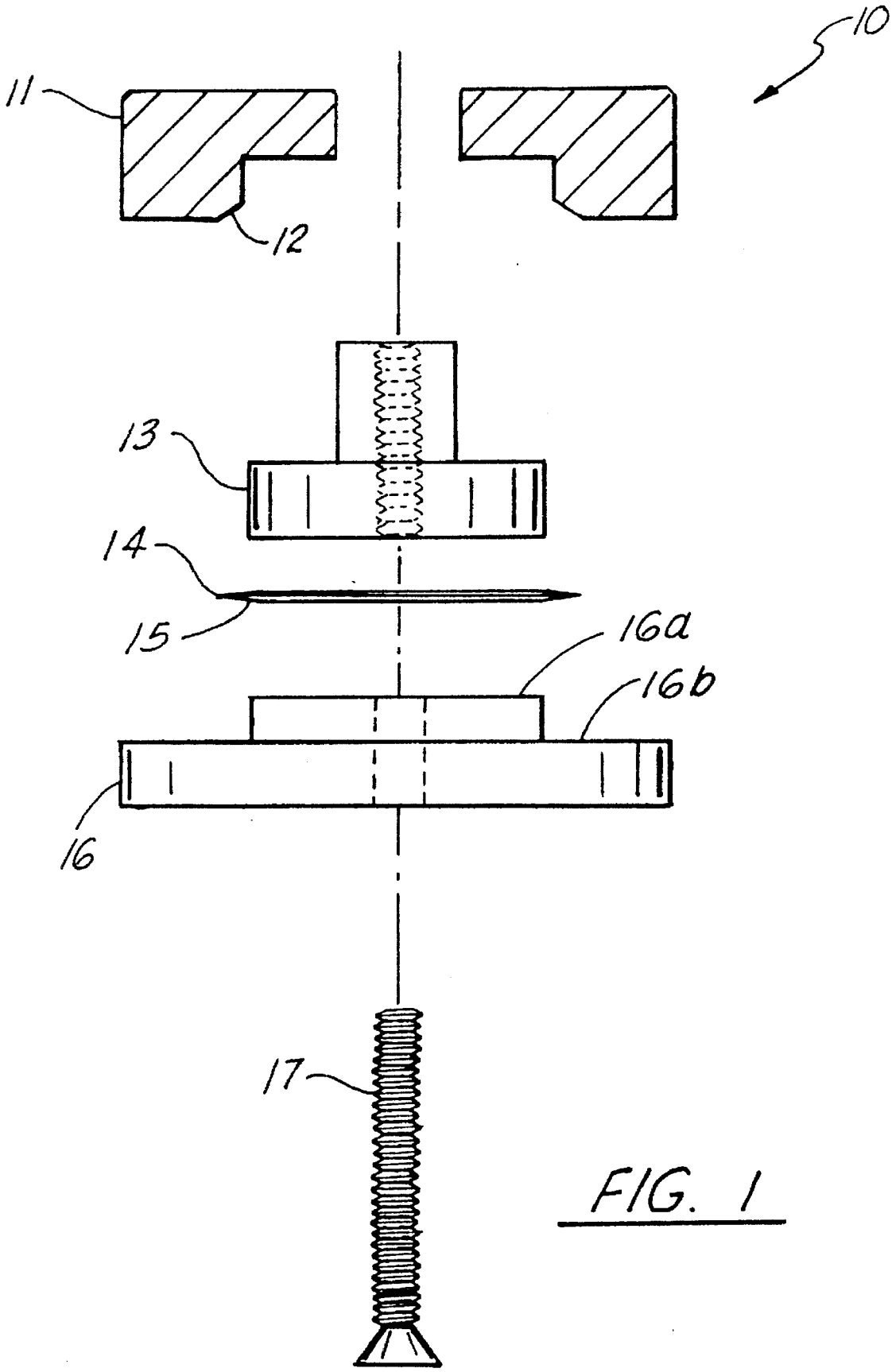
FIG. 1 is an exploded cross-sectional view of the preferred embodiment of the apparatus of the present invention.

FIG. 1 shows the tool 10 in exploded view with the numbered components identified as follows:

11 The round Upper Casing having

12 Abrasive bonded to an inner angled surface.

13 Inside-threaded Clamp.

14 Rotary Cutter Blade Cutting Edge

15 Rotary Cutter Blade.

16 Platform:

**16*a*** Smaller surface

**16*b*** Larger surface.

17 Central threaded Shank.

FIG. 2 is the tool 10 shown in slightly opened position. Screwing down clamp 13 on shank 17 binds blade against platform **16*a*. Upper casing 11 is then placed over clamp 13 until abrasive 12 contacts blade edge 14. Rotation of upper casing 11 causes abrasive 12 to act on blade edge 14, sharpening said edge 14**.

Platform 16 has an outside-threaded shank 17 attached vertically through its center, shank 17 being of sufficient length to accommodate the total height of the various components when the tool is assembled over shank 17, said shank 17 being approximately the diameter of the central positioning hole of rotary cutter blade 15.

The first step is to place blade 15 over shank 17 until blade 15 is resting on the smaller surface **16*a* of platform 16**.

The inside-threaded clamp 13 is then screwed down shank 17 tightly onto blade 15, restraining blade 15 from turning.

Upper casing 11, having a central hole of such dimension as to allow it to be placed over clamp 13, is then lowered over clamp 13 and pressed down until abrasive 12 comes into contact with blade edge 14.

The lower surface of casing 11 is in this position almost touching the upper surface **16*b* of platform 16, preventing the lower surface of casing 11 from causing blade edge 14** to bend and possibly break.

Upper casing 11 is then rotated in clockwise and counterclockwise motion around clamp 13, this motion causing the abrasive 12 to act upon blade edge 14 thereby sharpening it.

Upper casing 11 is then removed, clamp 13 unscrewed and removed, blade 15 turned over and the process repeated, resulting in blade edge 14 being sharpened on both sides.

An alternate embodiment 50 of the tool of the present invention is presented which differs from the above preferred embodiment 10 of the tool in that the blade is held in place by different means.

This embodiment of the tool of the present invention is also used to sharpen rotary cutter blades and is comprised of two cup-shaped casings, one containing an abrasive strip to sharpen the blade edge and the other being a receptacle for holding the blade. When the two are juxtaposed, a simple twisting or rotating of the one on the other causes the abrasive strip to act on the blade edge, sharpening it.

Figure 4:
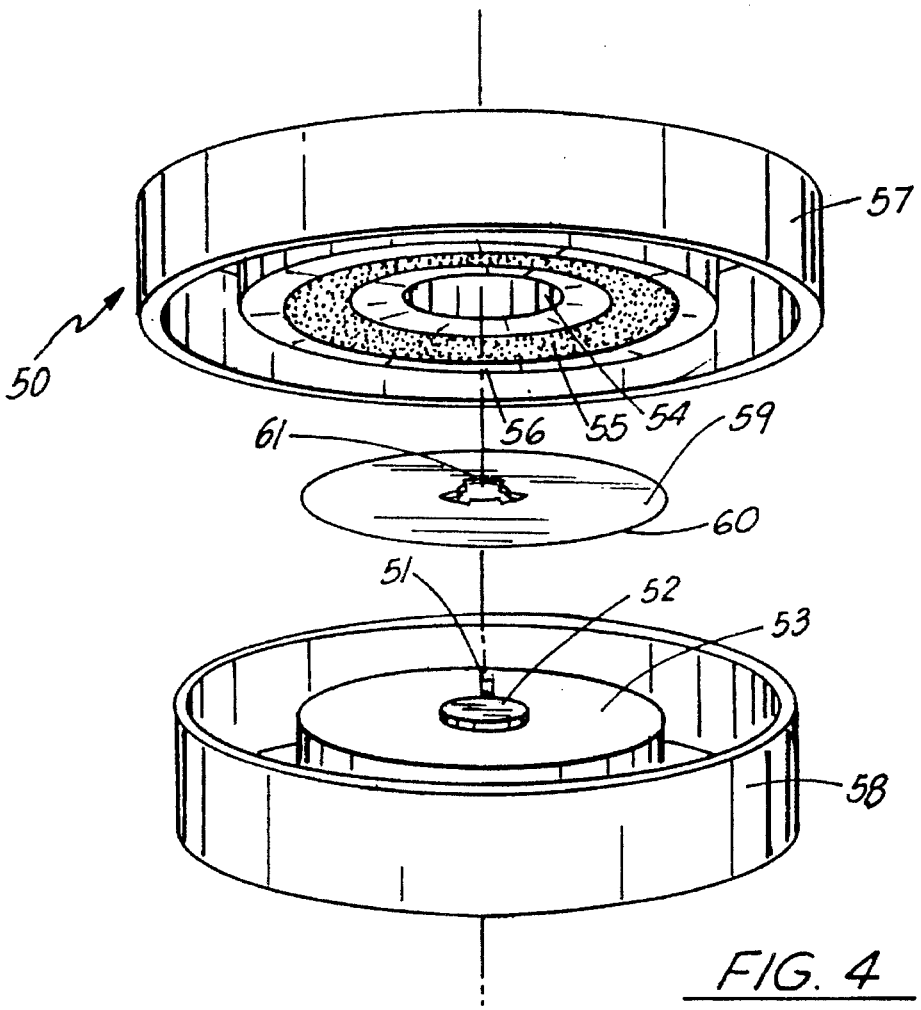
FIG. 4 is an exploded perspective view of an alternate embodiment of the apparatus of the present invention; and, FIG. 5 is an exploded front view of the embodiment of FIG. 4.
Figure 5:
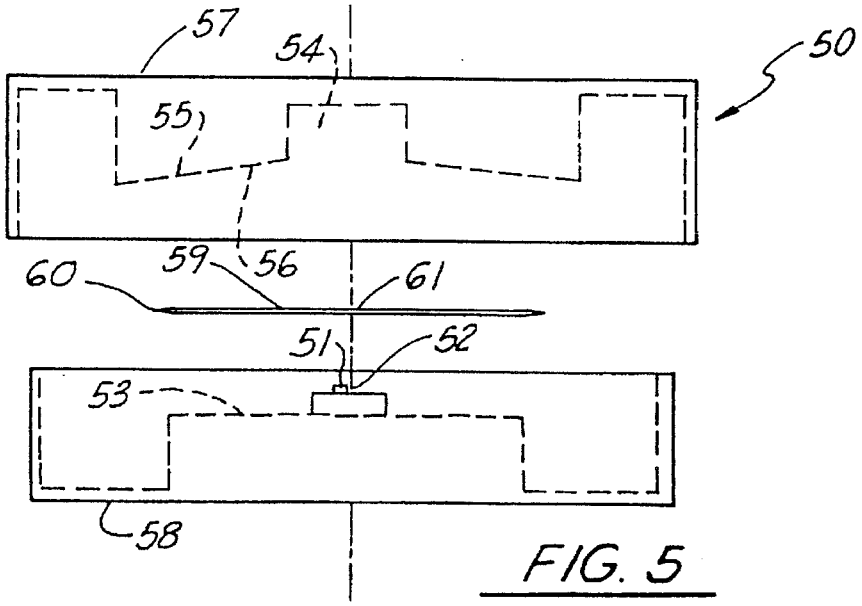

Alternate embodiment components:

FIGS. 4 and 5 show the elements as follows:

51 The Hub Key

52 The Hub

53 The Hub Platform

54 Cavity for Hub insertion

55 Abrasive Strip

56 Upper Platform carrying Abrasive Strip

57 Upper Casing

58 Lower Casing

59 Rotary Cutter Blade

60 Rotary Cutter Blade Edge

61 Blade centering hole with slots

A dulled blade 59 is placed over hub 52 on platform 53 in the inner casing 58 so that hub key 51 protrudes through one of the slots 61 of the blade centering hole, restraining blade 59 from rotating.

Outer casing 57, being of slightly larger circumference than inner casing 58, is fitted around casing 58, forming a closed, circular two-part box.

In this position, abrasive strip 55, affixed at a certain angle on platform 56 inside casing 57, comes into contact with blade edge 60 of blade 59 on the hub platform 53 inside inner casing 58.

By rotating outer casing 57 clockwise and anti-clockwise around inner casing 58, abrasive strip 55 acts on blade edge 60, sharpening said edge.

Outer casing 57 can then be removed from inner casing 58, blade 59 removed and turned over, replaced onto keyed hub 52 on platform 53, and the process repeated, thus sharpening both sides of blade edge 60.

What is claimed as invention is:

1. A hand-held abrasive tool for holding a circular cutting blade along a central axis of the tool and sharpening a cutting edge of said circular cutting blade comprising a platform having a threaded shank disposed along the central axis of the tool for receiving said circular cutting blade, a threaded clamp threadably received on the shank to restrain the blade from rotating, an upper circular casing having a circular opening for receiving the shank and an angled abrasive surface strip spaced radially outward and longitudinally along the axis from the opening for engaging the cutting edge of the circular blade when the upper casing is fitted over the threaded clamp wherein the upper casing is rotated in a clockwise and counter-clockwise motion about the central axis of the tool to cause the abrasive strip to sharpen the cutting edge of the blade.

2. A circular cutting blade sharpening tool comprising an inner casing and an outer casing which is larger than the inner casing in order to fit over the inner casing to form a two part circular box, the inner casing having a platform and a keyed hub extending from the platform to support and restrain the circular cutting blade, the outer casing having a platform with a circular angled abrasive surface extending from the platform for engaging and sharpening the edge of the circular blade when the outer casing is fitted over and around the inner casing wherein the circular cutting blade is sharpened when the outer casing is rotated in clockwise and counterclockwise fashion around the inner casing.

* * * * *